United States Patent [19]

Ashby

[11] Patent Number: 4,475,747

[45] Date of Patent: Oct. 9, 1984

[54] PACKING FORM

[75] Inventor: Robert E. Ashby, Quakertown, Pa.

[73] Assignee: Moore Business Forms, Inc., Grand Island, N.Y.

[21] Appl. No.: 470,530

[22] Filed: Feb. 28, 1983

[51] Int. Cl.[3] ..... B41L 1/20; B41L 1/26

[52] U.S. Cl. ..... 282/11.5 A; 282/21 R

[58] Field of Search ..... 281/45, 46, 47; 282/11.5 A, 11.5 R, 15 R; 283/81

[56] References Cited

U.S. PATENT DOCUMENTS

| | | | |
|---|---|---|---|
| 3,092,401 | 6/1963 | Steidinger | 282/22 R |
| 4,123,086 | 10/1978 | French | 282/21 R |
| 4,168,851 | 9/1979 | Halse | 282/11.5 A |
| 4,178,018 | 12/1979 | Halse | 282/11.5 A |
| 4,208,066 | 6/1980 | Steidinger | 282/21 R |

FOREIGN PATENT DOCUMENTS

| | | | |
|---|---|---|---|
| 2383023 | 3/1977 | France | 283/45 |

*Primary Examiner*—Robert L. Spruill
*Assistant Examiner*—Paul M. Heyrana, Sr.
*Attorney, Agent, or Firm*—Allegretti, Newitt, Witcoff & McAndrews, Ltd.

[57] ABSTRACT

A continuous business form assembly provides for computer generated packing slips in adhesive-backed packing envelopes with accompanying packing slip records. A narrow back web with adhesive provides packing slip envelope back panels. A superimposed wide insert web has a non-marginal registry strip inward of a marginal strip, transverse die cuts, and provides product packing slips between snap out perforation lines. A superimposed, narrow front web has a superimposed registry strip, snap perforation lines, and provides packing slip envelope front panels. A narrow adhesive protective web underlies the packing slip envelope back panels, and a wide record web is superimposed on the front web. If desired, feed strips of removed units of the assembly may be left in printer tractors to feed the remainder of the assembly.

3 Claims, 5 Drawing Figures

70
72
24
82
74
60
84
149
106
76
64
16
83
30
68
109
78
84
149
24
52
66
36
62
24
80
84
58
84
86
84
28
24
92
90
149
24
52
149
88
10
14
24
50
54
149
24
149
56
24
12
24
149

46
44
42
26
48
49
24
149

PACKING FORM

BACKGROUND AND SUMMARY OF THE INVENTION

This invention relates to a continuous business form assembly, and more particularly, to such an assembly providing for computer-generated product packing slips in adhesive-backed packing envelopes with accompanying packing slip records.

The term "longitudinal," when used to describe edges, rows or lines, means the edges, rows or lines extend in a longitudinal direction. The term "transverse," when used to describe edges, rows, lines or die cuts, means the edges, rows, lines or die cuts extend in a transverse direction. The term "superimposed on," when used to describe the physical relationships of edges, rows, or lines, means certain of the edges, rows or lines are physically directly above the other of the edges, rows or lines. The term "superimposed over," when used to describe the relationships of webs, sheets, panels or slips, means certain of the webs, sheets, panels or slips are physically directly above other of the webs, sheets, panels or slips, without regard to whether the edges, lines or die cuts which define the peripheries of the certain webs, sheets, panels, or slips are superimposed on the edges, lines or die cuts which define the peripheries of the other webs, sheets, panels, or slips. The term "marginal," when used to describe the edges, rows or lines of the web or sheet, means the edges, rows or lines are along the longitudinal edges, or margins, of the web or sheet, without regard to whether they are along a margin of the form assembly.

Continuous business form assemblies have been constructed and patented in the past, known as Speedi-web TM forms, which include a limited number of sheet thicknesses in the margins. Other forms have been disclosed which include die cuts, and still others which include non-marginal feed strips for collating narrow width webs with wider webs.

An object of this invention is to provide a continuous business form assembly providing for computer-generated product packing slips in packing envelopes.

Another object is to provide such form assemblies with a limited number of sheet thicknesses in the margins.

Yet another object is to provide such form assemblies with the packing slips being readily removable from the envelopes.

A further object is to provide such form assemblies with adhesive-backed packing envelopes.

A still further object is to provide such form assemblies adapted for stacking of the packing envelopes without tenting.

In a principal aspect, the present invention is an improved, continuous business form assembly providing product packing slips in adhesive-backed envelopes, and corresponding records of the packing slips, adapted to be fed through automatic printing means for simultaneous printing of the packing slips of the envelopes, and the corresponding records. The assembly comprises three longitudinally continuous webs, i.e., a back web, an insert web and a front web.

The back web has opposed marginal edges, a transverse width, a marginal row of registry holes along a first of the marginal edges, a front, and longitudinally spaced, transverse lines of perforations extending between the marginal edges. The back web forms product packing slip envelope pack panels.

The insert web is superimposed over the back web, and has opposed marginal edges outward of the back web marginal edges, a transverse width substantially greater than the back web within, and marginal feed strips along the insert web marginal edges. The marginal feed strips include marginal rows of feed holes along the insert web marginal edges and marginal lines of perforations transversely inward of the insert web marginal feed holes. The insert web further has a non-marginal registry strip transversely inward of a first of the insert web marginal feed strips including a non-marginal row of registry holes superimposed on the back web registry holes, and a longitudinal, first non-marginal line of perforations transversely inward of the insert web non-marginal registry holes and one of the back web marginal edges. A longitudinal, second non-marginal line of perforations is located transversely inward of the first non-marginal perforations. A longitudinal, third non-marginal line of perforations is located transversely inward of the second of the back web marginal edges. Longitudinally spaced, transverse die cuts extend between the first insert web marginal perforations and the third non-marginal perforations. The die cuts are superimposed over portions of the back web transverse perforations. Longitudinally spaced, transverse lines of perforations between the insert web marginal edges and the die cuts are superimposed on portions of the back web transverse perforations. The insert web still further has a face and a back. It forms product packing slips between the insert web second and third non-marginal perforations and the die cuts, with the slips superimposed over the back web packing slip envelope back panels.

A first set of longitudinal lines of adhesive joins the insert web back to the back web face. One such adhesive line is transversely inward of the third non-marginal perforations. Another such adhesive line is between the first marginal perforations and the first non-marginal perforations.

The front web is superimposed over the insert web, and has opposed marginal edges, a transverse width substantially equal to the first web width, and a marginal row of feed holes along one of the front web marginal edges superimposed on the insert web non-marginal feed holes and the back web feed holes. A marginal line of perforations is located transversely inward of the front web feed holes and transversely outward of the first non-marginal perforations. A longitudinally extending, non-marginal line of perforations is located transversely inward of the front web marginal perforations and superimposed on the second non-marginal perforations of the insert web. The front web further has a face, a back, and longitudinally spaced, transverse lines of perforations superimposed on the back web and insert web transverse perforations. The front web forms product packing slip envelope front panels superimposed over the insert web packing slips and the back web packing slip back panels.

A second set of longitudinal and longitudinally spaced, transverse lines of adhesive joins the front web back to the insert and back web faces. One such longitudinal line is transversely outward of the insert web first non-marginal perforations. Another of such longitudinal adhesive lines is transversely between the insert web first and second non-marginal perforations. A third such longitudinal adhesive line is transversely between the insert web third non-marginal perforations and the adjacent edge of the front web. The transverse adhesive lines are longitudinally adjacent in both longitudinal directions the transverse perforations of the back and front webs in the area of the die cuts.

Further objects, features and advantages of the invention are provided in the detailed description which follows.

DETAILED DESCRIPTION OF THE PREFERRED EMBODIMENT

Figure 1:
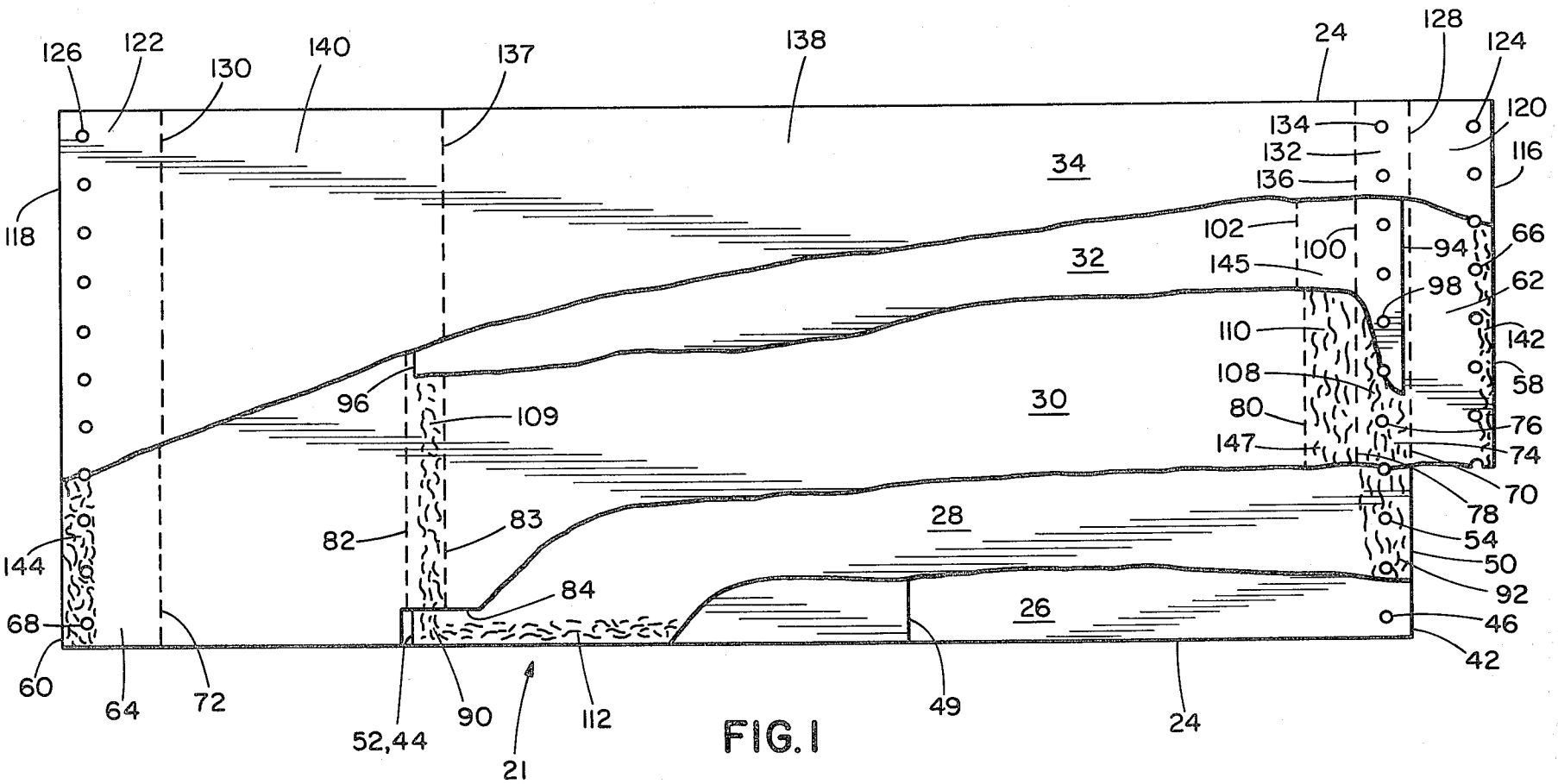
FIG. 1 is a cut-away view of one form of the preferred form assembly.
Figure 2:
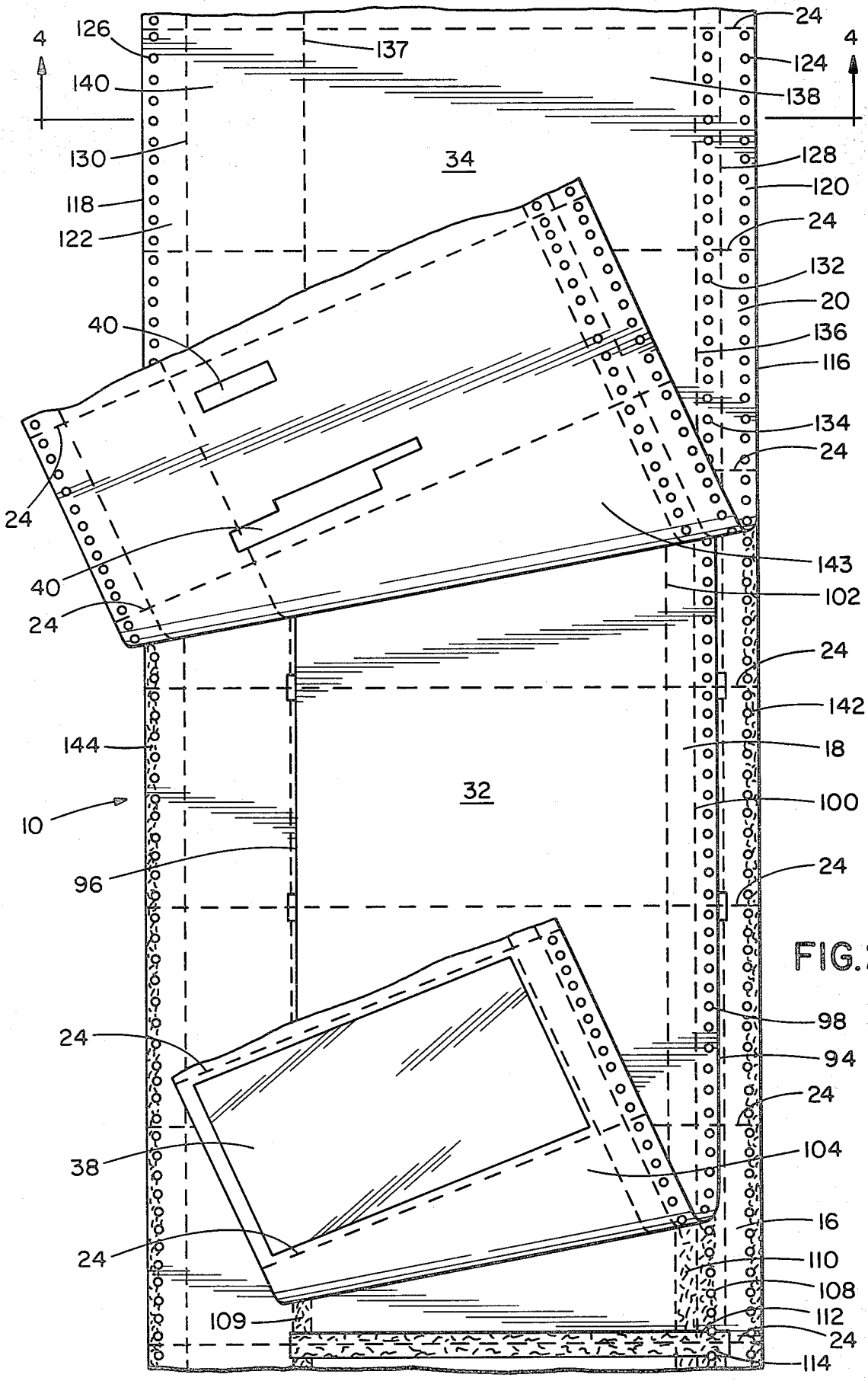
FIGS. 2 and 3 are views together showing the preferred form assembly during assembly thereof.
Figure 3:
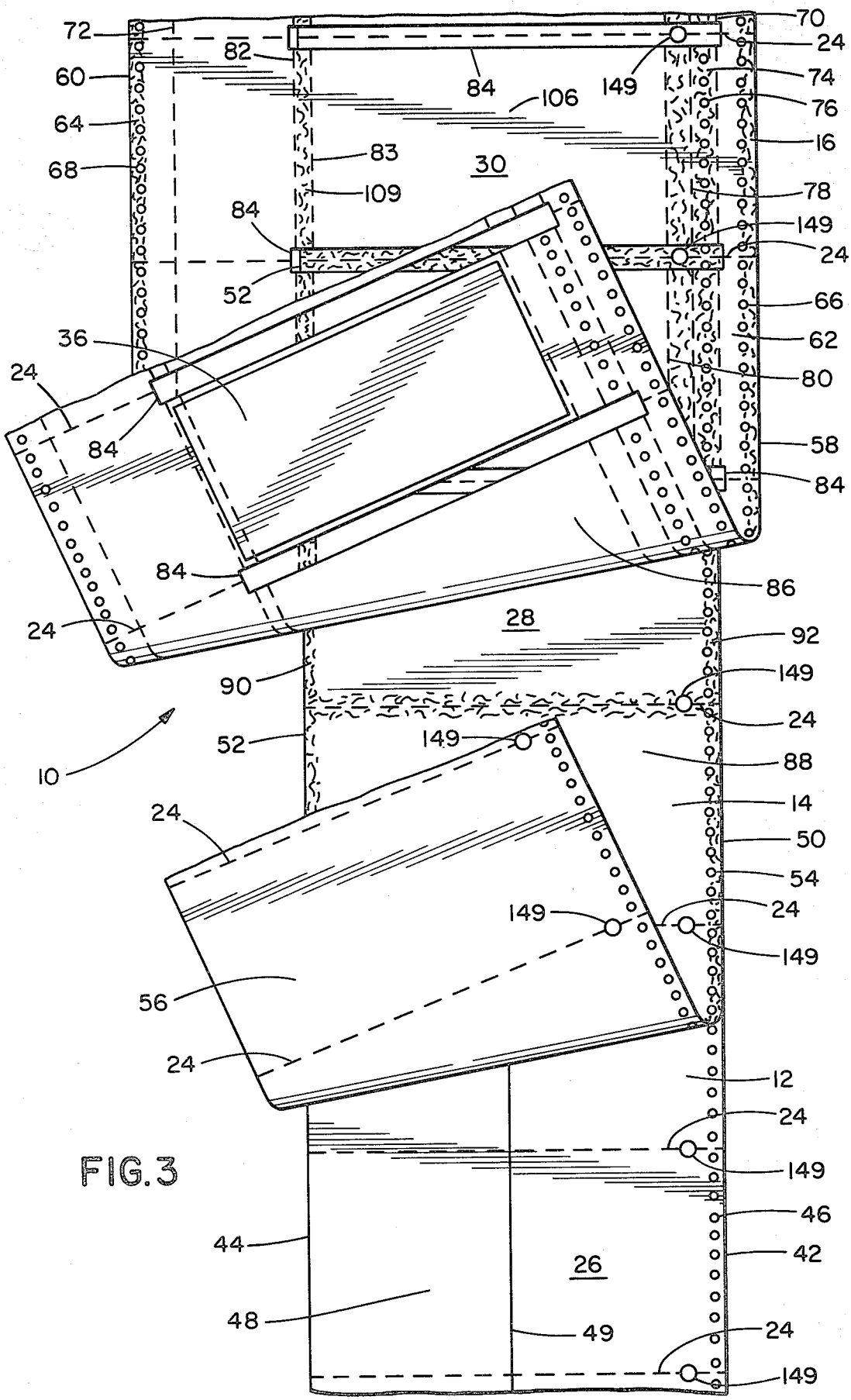
Figure 4:
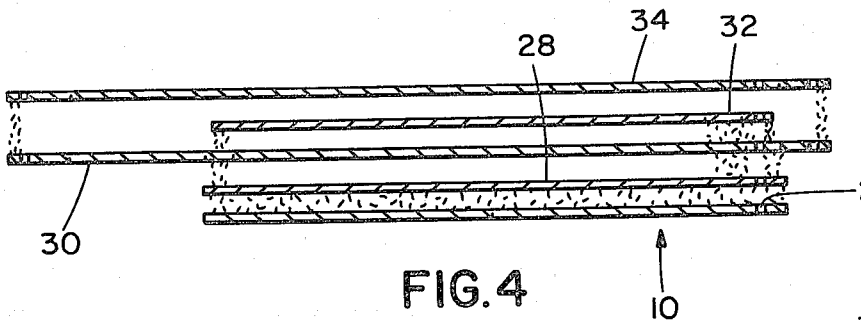
FIG. 4 is a diagrammatic section view of the preferred form assembly taken along line 4—4 of FIG. 2.

Referring first to FIGS. 2 and 3, a preferred, continuous business form assembly 10 includes a first web 12 shown in FIG. 3, a second web 14 shown in FIG. 3, a third web 16 shown in FIGS. 2 and 3, a fourth web 18 shown in FIG. 2 and a fifth web 20 shown in FIG. 2. The webs 12, 14, 16, 18 and 20 are superimposed in numbered order over each other, and each includes a series of longitudinally spaced, transverse lines of perforations 24 superimposed on the other transverse perforations 24 of the other webs. Thus, form assembly 10 defines series of identical form units, such as form unit 21 in FIG. 1.

Referring now to FIG. 1–3, the first web 12 forms first sheets 26, the second web 14 forms second sheets 28, the third web 16 forms third sheets 30, the fourth web 18 forms fourth sheets 32, and the fifth web 20 forms fifth sheets 34. The sheets 26, 28, 30, 32, 34 are rectangular. Sheets 30 and 34 are of the same size, and sheets 26, 28, 32 are of substantially the same size.

The first web 12 is an adhesive protective web with sheets 26 formed of a release, adhesive protective material. The second web 14 is a back web, with sheets 28 being product packing slip envelope back panels. The third web 16 is an insert web, with sheets 30 including product packing slips. The fourth web 18 is a front web. Sheets 32 are product packing slip envelop front panels. Finally, the fifth web 20 is a record web, with sheets 34 forming one or more records of the packing slips. As shown in FIGS. 2 and 3, the backs of the sheets 30, 32, 34 have areas 36, 38, 40, respectively, of carbonized copy coatings as desired, for simultaneous, computerized or manual imprinting of the records, packing slips and envelope back panels.

The first web 12 is continuous in the longitudinal direction, and has opposed, longitudinal, marginal edges 42, 44. A longitudinal row of registry holes 46 is along the first marginal edge 42. The adhesive release material costs the face 48 of the web 12. A longitudinal cut line 49 is at the center of the sheets 26.

The second web 14 is also longitudinally continuous, and is superimposed over the first web 12. The second web 14 has opposed, longitudinal, marginal edges 50, 52 superimposed, respectively, on the first web marginal edges 42, 44. The transverse widths of the two webs 12, 14 are substantially equal. A longitudinal row of registry holes 54 is along the first marginal edge 50 of the second web 14 superimposed on the first web registry holes 46. An adhesive material coats the back 56 of the second web 14. The back 56 is superimposed on the face 48 of the first web 12. The adhesive release material protects the adhesive on the back 56.

The third web 16 is also longitudinally continuous, and is superimposed over the second web 14. The third web 16 has opposed, marginal edges 58, 60 outward of the first and second web marginal edges 42, 44, 50, 52. The transverse width of the third web 16 is substantially greater than the width of the first and second webs 12, 14. Longitudinal, marginal, removable, feed strips 62, 64 are along the third web marginal edges 58, 60. The strips 62, 64 include, respectively, longitudinal, marginal rows of feed holes 66, 68 along the third web marginal edges 58, 60. The strips 62, 64 also include, respectively, longitudinal, marginal lines of perforations 70, 72 transversely inward of the third web marginal feed holes 66, 68.

A longitudinal, non-marginal, registry strip 74 is located transversely inward of the first, third web marginal feed strip 62. The strip 74 includes a longitudinal, non-marginal, row of registry holes 76 superimposed on the first and second web registry holes 46, 54. The strip 74 further includes a longitudinal, first non-marginal line of perforations 78 transversely inward of the third web non-marginal registry holes 76. A longitudinal, second non-marginal line of perforations 80 is transversely inward of the first non-marginal perforations 78. A longitudinal, third non-marginal line of perforations 82 is transversely outward of the second, second web marginal edge 52. A longitudinal, fourth non-marginal line of perforations 83 is transversely inward of the edge 52.

Longitudinally spaced, transverse die cuts 84 extend transversely between and slightly outward beyond the third web marginal perforations 70 and the third web, third non-marginal perforations 82. The die cuts 84 are superimposed over portions of the first and second web transverse perforations 24. The transverse lines of perforations 24 of the third web 16 extend between the third web marginal edges 58, 60 and the die cuts 84. The third web 16 forms the product packing slips between the second and fourth non-marginal perforations 80, 83 and the die cuts 84. The slips are superimposed over the second web packing slip envelope back panels.

A first set of longitudinal lines of adhesive join the third web back 86 to the second web face 88. A first such adhesive line 90 is between the third and fourth non-marginal perforations 82, 83. A second such adhesive line 92 is between the first marginal perforations 70 and the first non-marginal perforations 78.

The longitudinally continuous fourth web 18 is superimposed over the third web 16. The web 18 has transversely separated, marginal edges 94, 96, and a transverse width substantially equal to the first web width. A longitudinal row of registry holes 98 is along the first, fourth web marginal edge 94 and superimposed on the non-marginal registry holes 76 of the third web and the first and second web registry holes 46, 54. A longitudinal, marginal line of perforations 100 is transversely inward of the fourth web registry holes 98 and superimposed on the first non-marginal perforations 78 of the third web 16. A longitudinally extending, non-marginal line of perforations 102 is transversely inward of the fourth web marginal perforations 100 and of the second non-marginal perforations 80 of the third web 16. The fourth web 18 forms product packing slip envelope front panels superimposed over the third web packing slips and the second web packing slip back panels.

A second set of longitudinal and longitudinally spaced, transverse lines of adhesive joins the fourth web back 104 to the second and third web faces 88, 106. A first such longitudinal line 108 is transversely outward of the first non-marginal perforations 78 of the third web 16. A second such longitudinal adhesive line 110 is transversely between the first and second non-marginal perforations 78, 80 of the third web 16. A third such longitudinal adhesive line 109 is transversely between the third and fourth non-marginal perforations 82, 83 of the third web 16 and transversely inward of the adjacent edge 52 of the fourth web 18. A series of transverse adhesive lines 112, 114 are longitudinally adjacent in both longitudinal directions the transverse perforations 24 of the second and fourth webs 14, 18 in the area of the die cuts 84.

The fifth web 20 is longitudinally continuous and superimposed over the fourth web 18. It has transversely separated, longitudinal, marginal edges 116, 118, and a transverse width substantially equal to the third web width. Longitudinal, marginal, removable, feed strips 120, 122 are along the fifth web marginal edges 116, 118, respectively. The strips 120, 122 include longitudinal, marginal rows of feed holes 124, 126, respectively, superimposed on the third web marginal feed holes 66, 68, and longitudinal, marginal lines of perforations 128, 130 transversely inward of the fifth web feed holes 124, 126. The first of the fifth web marginal lines of perforation 128, 130 is superimposed on the first of the third web marginal perforations 66, 68. A longitudinal, non-marginal registry strip 132 is transversely inward of the fifth web first marginal perforations 128. The strip 132 includes a longitudinal, non-marginal row of registry holes 134 superimposed on the fourth web non-marginal registry holes 98, and a longitudinal, first non-marginal line of perforations 136 transversely inward of the fifth web non-marginal registry holes 134, and superimposed on the first non-marginal perforations 100 of the fourth web 18. A second non-marginal line of perforations 137 is superimposed on the fourth non-marginal line of perforations 83 of the third web 16. The fifth web 20 forms record panels 138, 140 of the packing slips of the third web 16. The panels 138 are superimposed over the fourth web packing slip front panels, the third web packing slips and the second web packing slip back panels.

A third set of longitudinal lines of adhesive join the back 143 of the fifth web 20 to the face 106 of the third web 16. Two such adhesive lines 142, 144 are in the area of the marginal feed holes 66, 68 of the third web 16. The preferred assembly 10 is used by imprinting and removal of form units 21 from a printer, in series or singly. If desired, feed strips 62, 64, 120, 122 of a form unit 21 may be left in the tractors of the printer, to feed the remainder of the assembly 10. If not, they may be removed.

Referring to FIG. 1, the record panels 138, 140 are removed, and filed or otherwise used as desired. The strip of the third web between perforation lines 72, 82 may also be removed.

The remainder of the form unit 21 is a filled, packing slip envelope assembly. This assembly is used by removal of sheet 26 to expose the adhesive on the back 56 of the assembly, and placement of the assembly on a product.

Upon arrival of the product at its destination, the envelope assembly is opened and the product packing slip removed. The strip 145 of the fourth sheet 32, which is between the perforation lines 100, 102 may be torn from the assembly. Because of adhesive line 110, removal of the strip 145 causes removal of the underlying strip 147, and perforation of the perforation lines 78, 80.

To facilitate removal of the strips 145, 147, the first and second webs 12, 14 may include punches 149 along the transverse perforation lines 24 inward of the registry line 54, such that in the assembly 10, the punches 149 underlie the strips 145, 147. The punching facilitates grasping of the strips 145, 147.

With the edge portion of the strips 145, 147 removed, packing slip between the perforation lines 102, 80 is exposed to view. This edge may be grasped and the packing slip snapped free along perforation line 83.

Figure 5:
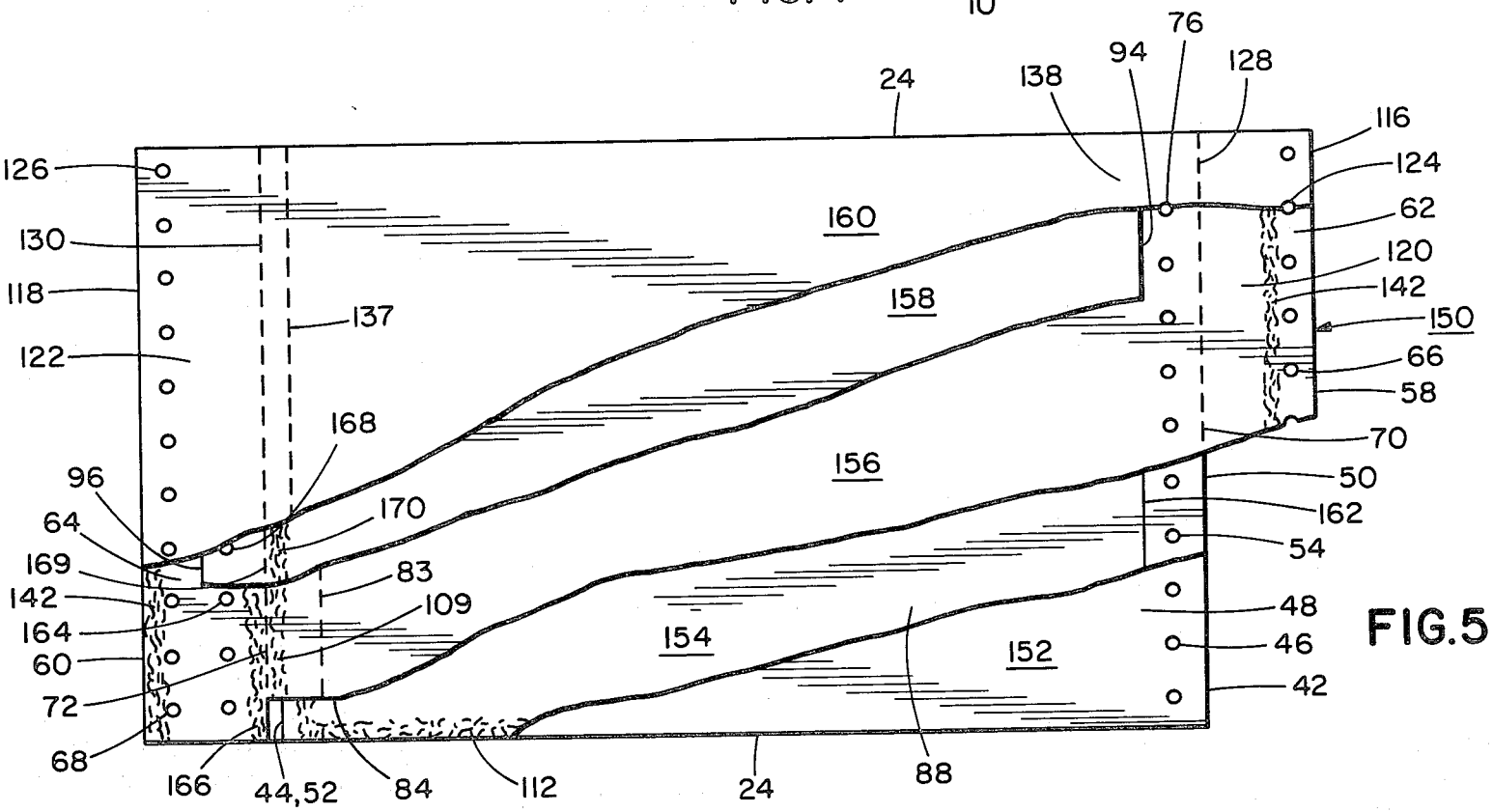
FIG. 5 is a cut-away view similar to FIG. 1, of a second preferred form assembly.

The second preferred form assembly provides form units 150 as in FIG. 5. First, second, third, fourth and fifth sheets 152, 154, 156, 158, 160 are formed of first through fifth webs (not shown). The first and second sheets 152, 154 of the unit 150 are identical, respectively, to the first and second sheets 26, 28 of the unit 20, with the exception of the absence of the punches 149 and the presence of a longitudinal cut line 162 transversely inward of the feed holes 54. Adhesive line 92 is excluded. The third sheet 156 varies from the third sheet 30 to exclude elements 78, 80, 82, 108, 110, 147 and include a second non-marginal line of registry holes 164. Adhesive lines 108, 112 are excluded. The marginal edge 94 of the fourth sheet 158 terminates where perforation line 100 exists on fourth sheet 32, and the edge 96 extends across the feed holes 164. The fourth sheet 158 includes registry holes 168 superimposed on registry holes 164, and marginal perforation line 169 superimposed on perforation line 72. An adhesive line 166 between the registry hole lines 164, 168 and the perforation lines 72, 169 joins the sheets 156, 158. The fifth sheet 160 excludes elements 132, 134, 136, 140. An adhesive line 170 is superimposed on the adhesive line 109 and joins the sheets 158, 160.

The unit 150 is used like the unit 21. Notably, the strips 145, 147 and punches 149 are absent. With the sheet 160 removed, the portion of the sheet 156 between the edges 94 of the sheet 158 and the perforation line 70 of the sheet 156 is exposed to view and not attached to sheet 158 or sheet 154. Thus, the envelope assembly of the unit 150 thus forms an open, not closed, envelope.

The preferred embodiments of the invention are now described. To particularly point out and distintly claim the subject matter regarded as invention, the following claims conclude this specification.

What is claimed is:

1. An improved, continuous business form assembly providing product packing slips in adhesive-backed envelopes, and corresponding records of the packing slips, adapted to be fed through automatic printing means for simultaneous printing of the packing slips of the envelopes, and the corresponding records, comprising:

a longitudinally continuous back web having opposed marginal edges, a transverse width, a marginal row of registry holes along a first of the marginal edges, a front, and longitudinally spaced, transverse lines of perforations extending between the marginal edges, the web forming product packing slip envelope back panels;

a longitudinally continuous insert web superimposed over the back web, having opposed marginal edges outward of the back web marginal edges, a transverse width substantially greater than the back web width, marginal feed strips along the insert web marginal edges including marginal rows of feed holes along the insert web marginal edges and marginal lines of perforations transversely inward of the insert web marginal feed holes, a non-marginal registry strip transversely inward of a first of the insert web marginal feed strips including a non-marginal row of registry holes superimposed on the back web registry holes, and a longitudinal, first non-marginal line of perforations transversely inward of the insert web non-marginal registry holes and one of the back web marginal edges, a longitudinal, second non-marginal line of perforations transversely inward of the first non-marginal perforations, a longitudinal, third non-marginal line of perforations transversely outward of the second of the back web marginal edges, a longitudinal, fourth non-marginal line of perforations transversely inward of the second, back web marginal edge, longitudinally spaced, transverse die cuts extending between the first insert web marginal perforations and the third non-marginal perforations, and superimposed over portions of the back web transverse perforations, longitudinally spaced, transverse lines of perforations between the insert web marginal edges and the die cuts superimposed on portions of the back web transverse perforations, a face and a back, the insert web forming product packing slips between the insert web second and third non-marginal perforations and the die cuts, the slips superimposed over the back web packing slip envelope back panels;

a first set of longitudinal lines of adhesive joining the insert web back to the back web face, one such adhesive line being transversely inward of the third non-marginal perforations and another such adhesive line being between the first marginal perforations and the first non-marginal perforations;

a longitudinally continuous front web superimposed over the insert web, having opposed marginal edges, a transverse width substantially equal to the back web width, a marginal row of registry holes along one of the front web marginal edges, superimposed on the insert web non-marginal registry holes and the back web registry holes, a marginal line of perforations transversely inward of the front web registry holes and transversely outward of the first non-marginal perforations, a longitudinally extending, non-marginal line of perforations transversely inward of the front web marginal perforations and transversely inward of the second non-marginal perforations of the insert web, a face, a back, longitudinally spaced, transverse lines of perforations superimposed on the back web and insert web transverse perforations, the front web forming product packing slip envelope front panels superimposed over the insert web packing slips and the back web packing slip back panels; and a second set of longitudinal and longitudinally spaced, transverse lines of adhesive joining the front web back to the insert and back web faces, one such longitudinal line being transversely outward of the insert web first non-marginal perforations, another of such longitudinal adhesive lines being transversely between the insert web first and second non-marginal perforations and a third such longitudinal adhesive line being transversely between the insert web third and fourth non-marginal perforations, the transverse adhesive lines being longitudinally adjacent in both longitudinal directions the transverse perforations of the back and front webs in the area of the die cuts.

2. An improved, continuous business form assembly providing product packing slips in adhesive-backed envelopes, and corresponding records of the packing slips, adapted to be fed through automatic printing means for simultaneous printing of the packing slips, the envelopes, and the corresponding records, comprising:

a first web being continuous in a longitudinal direction, having opposed, longitudinal, marginal edges, a transverse first web width, a longitudinal row of registry holes along a first of the marginal edges, a face, an adhesive release material coating at least a portion of the face, and longitudinally spaced, transverse lines of perforations extending between the marginal edges;

a longitudinally continuous second web superimposed over the first web, having opposed, longitudinal, marginal edges superimposed on the first web marginal edges, a transverse width substantially equal to the first web width, a longitudinal row of registry holes along a first of the second web marginal edges superimposed on the first web registry holes, a front, a back, an adhesive material coating at least a portion of the second web back superimposed on the first web adhesive release material, and longitudinally spaced, transverse lines of perforations extending between the marginal edges of the second web and superimposed on the first web transverse perforations, the second web forming product packing slip envelope back panels;

a longitudinally continuous third web superimposed over the second web, having opposed, longitudinal, marginal edges outward of the first and second web marginal edges, a transverse third web width substantially greater than the first web width, longitudinal, marginal, removable, feed strips along the third web marginal edges including longitudinal, marginal rows of feed holes along the third web marginal edges and longitudinal, marginal lines of perforations transversely inward of the third web marginal feed holes, a longitudinal, non-marginal, registry strip transversely inward of a first of the third web marginal feed strips including a longitudinal, non-marginal, row of registry holes superimposed on the first and second web registry holes, and a longitudinal, first non-marginal line of perforations transversely inward of the third web non-marginal registry holes and a first of the second web marginal edges, a longitudinal, second non-marginal line of perforations transversely inward of the first non-marginal perforations, a longitudinal, third non-marginal line of perforations transversely inward of the second of the second web marginal edges, a longitudinal, fourth non-marginal line of perforations transversely inward of the third non-marginal line of perforations, longitudinally spaced, transverse die cuts extending between the first, third web marginal perforations and the third, third web non-marginal perforations and superimposed over portions of the first and second web transverse perforations, longitudinally spaced, transverse lines of perforations between the third web marginal edges and the die cuts superimposed on portions of the first and second web transverse perforations, a face and a back, the third web forming product packing slips between the second and third non-marginal perforations and the die cuts, the slips superimposed over the second web packing slip envelope back panels;

a first set of longitudinal lines of adhesive joining the third web back to the second web face, one such adhesive line being between the third and fourth non-marginal perforations and another such adhesive line being between the first marginal perforations and the first non-marginal perforations;

a longitudinally continuous fourth web superimposed over the third web, having transversely separated, longitudinal, marginal edges, a transverse width substantially equal to the first web width, a longitudinal row of registry holes along one of the fourth web marginal edges superimposed on the third web non-marginal feed holes and the first and second web registry holes, a longitudinal marginal line of perforations transversely inward of the fourth web registry holes and transversely outward of the first non-marginal perforations, a longitudinally extending, non-marginal line of perforations transversely inward of the fourth web marginal perforations and transversely outward of the second non-marginal perforations of the third web, a face, a back, longitudinally spaced, transverse lines of perforations superimposed on the first, second and third web transverse perforations, the fourth web forming product packing slip envelope front panels superimposed over the third web packing slips and the second web packing slip back panels;

a second set of longitudinal and longitudinally spaced, transverse lines of adhesive joining the fourth web back to the second and third web faces, one such longitudinal line being transversely outward of the first non-marginal perforations of the third web, another of such longitudinal adhesive line being transversely between the first and second non-marginal perforations of the third web and a third such longitudinal adhesive line being transversely between the third and fourth non-marginal perforations of the third web, the transverse adhesive lines being longitudinally adjacent in both longitudinal directions the transverse perforations of the second and fourth webs in the area of the die cuts;

a longitudinally continuous fifth web superimposed over the fourth web having transversely separated, longitudinal, marginal edges, a transverse width substantially equal to the third web width, longitudinal, marginal, removable, feed strips along the fifth web marginal edges including longitudinal, marginal rows of feed holes superimposed on the third web marginal feed holes, longitudinal, marginal lines of perforations transversely inward of the fifth web feed holes, a first of the fifth web marginal lines of perforation being superimposed on the first of the third web marginal perforation, a longitudinal, non-marginal registry strip transversely inward of the fifth web first marginal perforations including a longitudinal, non-marginal row of registry holes superimposed on the third web non-marginal registry holes, a longitudinal, first non-marginal line of perforations transversely inward of the fifth web non-marginal registry holes, and a second non-marginal line of perforations superimposed on the first non-marginal perforations of the fourth web, and longitudinally spaced, transverse lines of perforations superimposed on the first, second, third and fourth web transverse perforations, the fifth web forming records of the packing slips of the third web superimposed over the fourth web packing slip front panels, the third web packing slips and the second web packing slip back panels; and a third set of longitudinal lines of adhesive joining the back of the fifth web to the faces of third and fourth webs, two such adhesive lines being in the area of the marginal feed holes of the third web.

3. An improved, continuous business form assembly providing product packing slips in adhesive-backed envelopes, and corresponding records of the packing slips, adapted to be fed through automatic printing means for simultaneous printing of the packing slips, the envelopes, and the corresponding records, comprising:

a first web being continuous in a longitudinal direction, having opposed, longitudinal, marginal edges, a transverse first web width, a longitudinal row of registry holes along a first of the marginal edges, a face, an adhesive release material coating at least a portion of the face, and longitudinally spaced, transverse lines of perforations extending between the marginal edges;

a longitudinally continuous second web superimposed over the first web, having opposed, longitudinal, marginal edges superimposed on the first web marginal edges, a transverse width substantially equal to the first web width, a longitudinal row of registry holes along a first of the second web marginal edges superimposed on the first web registry holes, a front, a back, an adhesive material coating at least a portion of the second web back superimposed on the first web adhesive release material, and longitudinally spaced, transverse lines of perforations extending between the marginal edges of the second web and superimposed on the first web transverse perforations, the second web forming product packing slip envelope back panels;

a longitudinally continuous third web superimposed over the second web, having opposed, longitudinal, marginal edges outward of the first and second web marginal edges, a transverse third web width substantially greater than the first web width, longitudinal, marginal, removable, feed strips along the third web marginal edges including longitudinal, marginal rows of feed holes along the third web marginal edges and longitudinal, marginal lines of perforations transversely inward of the third web marginal feed holes, a longitudinal, non-marginal, registry strip transversely inward of a first of the third web marginal feed strips including a longitudinal, non-marginal, first row of registry holes superimposed on the first and second web registry holes, a longitudinal, non-marginal, second row of registry holes in a second of the third web marginal feed strips, a longitudinal, second non-marginal line of perforations transversely inward of the second of the second web marginal edges, longitudinally spaced, transverse die cuts extending between the first and second third web marginal perforations and superimposed over portions of the first and second web transverse perforations, longitudinally spaced, transverse lines of perforations between the third web marginal edges and the die cuts superimposed on portions of the first and second web transverse perforations, a face and a back, the third web forming product packing slips between the first marginal perforations, the second non-marginal perforations and the die cuts, the slips superimposed over the second web packing slip envelope back panels;

a first set of longitudinal lines of adhesive joining the third web back to the second web face, one such adhesive line being between the second marginal perforations and the second non-marginal perforations;

a longitudinally continuous fourth web superimposed over the third web, having transversely separated, longitudinal, first and second marginal edges, a transverse width substantially equal to the first web width, a longitudinal row of registry holes along the second of the fourth web marginal edges, a longitudinal marginal line of perforations transversely inward of the fourth web registry holes and superimposed on the second non-marginal perforations of the third web, a face, a back, longitudinally spaced, transverse lines of perforations superimposed on the first, second and third web transverse perforations, the fourth web forming product packing slip envelope front panels superimposed over the third web packing slips and the second web packing slip back panels;

a second set of longitudinal and longitudinally spaced, transverse lines of adhesive joining the fourth web back to the second and third web faces, one such longitudinal line being transversely outward of the second marginal perforations of the third web, another of such longitudinal adhesive lines being transversely inward of the second marginal perforations of the third web, the transverse adhesive lines being longitudinally adjacent in both longitudinal directions the transverse perforations of the second and fourth webs in the area of the die cuts;

a longitudinally continuous fifth web superimposed over the fourth web having transversely separated, longitudinal, marginal edges, a transverse width substantially equal to the third web width, longitudinal, marginal, removable, feed strips along the fifth web marginal edges including longitudinal, marginal rows of feed holes superimposed on the third web marginal feed holes, longitudinal, marginal lines of perforations transversely inward of the fifth web feed holes and superimposed on the third web marginal perforations, and longitudinally spaced, transverse lines of perforations superimposed on the first, second, third and fourth web transverse perforations, the fifth web forming records of the packing slips of the third web superimposed over the fourth web packing slip front panels, the third web packing slips and the second web packing slip back panels; and a third set of longitudinal lines of adhesive joining the back of the fifth web to the faces of third and fourth webs, two such adhesive lines being in the area of the marginal feed holes of the third web.

* * * * *